United States Patent [19]

Theurer

[11] Patent Number: 4,497,255

[45] Date of Patent: Feb. 5, 1985

[54] MOBILE TRACK ALIGNMENT MACHINE

[75] Inventor: Josef Theurer, Vienna, Austria

[73] Assignee: Franz Plasser Bahnbaumaschinen Industriegesellschaft m.b.H., Vienna, Austria

[21] Appl. No.: 440,427

[22] Filed: Nov. 9, 1982

[30] Foreign Application Priority Data

Dec. 23, 1981 [AT] Austria ..... 5553/81

[51] Int. Cl.[3] ..... E01B 33/00

[52] U.S. Cl. ..... 104/8; 104/7 B; 33/1 Q; 33/287

[58] Field of Search ..... 104/7 R, 7 B, 12, 8; 33/1 Q, 287

[56] References Cited

U.S. PATENT DOCUMENTS 3,343,496 9/1967 Warnick ..... 104/7

FOREIGN PATENT DOCUMENTS 280331 8/1969 Austria .
295579 5/1971 Austria .
668359 8/1963 Canada .
1244824 7/1967 Fed. Rep. of Germany .
1199962 7/1970 United Kingdom .

*Primary Examiner*—Randolph Reese

*Assistant Examiner*—Glenn B. Foster

*Attorney, Agent, or Firm*—Kurt Kelman

[57] ABSTRACT

A mobile track alignment machine comprises a track alignment tool positioned in a track section to be aligned, a drive operating the tool for alignment of this track section, a control for the drive and a reference system for operating the drive control in response to an operating signal emitted by the reference system. The reference system includes a reference line extending along the track and three rail sensing elements each determining a respective ordinate of an arc in which the track extends, one of the rail sensing elements being arranged in the range of the track alignment tool means in the second track section, a second one of the rail sensing elements being arranged in a leading portion of the first track section adjacent the second track section, a third one of the rail sensing elements being arranged in a trailing portion of the first track section adjacent the leading first track section portion and an additional rail sensing element in the trailing portion, the additional rail sensing element being associated with a reference line sensing element for determining residual track alignment errors, the reference line sensing element associated with the additional rail sensing element emitting a correcting operating signal corresponding to the residual alignment error.

9 Claims, 5 Drawing Figures

MOBILE TRACK ALIGNMENT MACHINE

FIELD OF THE INVENTION

The present invention relates to a mobile track alignment machine, such as a track leveling and lining machine, mounted for mobility on the track rails for movement from an aligned, first track section to a second track section to be aligned.

The term "track alignment", as used throughout the specification and claims, refers to the correction of the track position in a vertical and/or lateral direction, i.e. correcting the level or grade of the track and/or its lateral alignment.

Known machines of this type comprise track alignment tool means positioned in the second track section, drive means operating the tool means for alignment of the second track section, a control for the drive means and a reference system for operating the drive means control in response to an operating signal emitted by the reference system. The reference system includes a reference line means forming a chord of an arc in which the track extends and three rail sensing elements each determining a respective ordinate or height of the arc. One of the rail sensing elements is arranged in the range of the track alignment tool means, a second rail sensing element is arranged in a leading portion of the first track section adjacent the second track section and a third rail sensing element is arranged in a trailing portion of the first track section adjacent the leading first track section portion. Various embodiments of such track alignment machines have been proposed and used. In all of them, the leading end point of the reference line, in relation to which the position of the second track section is corrected, is moved along this second track section to be aligned while the trailing reference system end point is moved along the first track section which has been aligned, the alignment operation being based on the so-called track position error reduction principle according to which the track position errors are reduced to an extent determined by the specific reference system and associated track alignment tool control arrangements.

DESCRIPTION OF PRIOR ART

U.S. Pat. No. 3,343,496, Canadian Pat. No. 668,359 and Austrian Pat. No. 280,331 disclose track alignment methods and machines based on this principle, using tensioned wires as reference lines. Operating signal emitting reference wire sensing elements determine the ordinate of the arc over the chord extending between two points of the track or the angle between two adjacent chords at least in the range of that rail sensing element whose position in relation to the reference line controls the leveling or lining movement of the track alignment tool means. These patented methods and machines have been successfully used in track rehabilitation work because of their simplicity, dependability and quite favorable track alignment error reduction ratios. However, because of constantly increasing train speeds and the corresponding requirement for enhanced track alignment accuracy, there have been further developments to reduce the track alignment errors even more so that any residual track alignment errors, which are unavoidable in a track alignment based upon the above-described principle, are reduced to a minimum.

In the mobile track lining machine disclosed in British Pat. No. 1,199,962, published July 22, 1970, the leading end point of the reference line, whose trailing end point lies in the aligned track section, is connected to a reference chord arranged ahead of the leading reference line end point, preferably substantially to the center of the reference chord. Since the remaining track alignment error in all of the conventional methods and machines is due to the fact that the front end of the reference chord for the control of the alignment tools lies in a track section which has not yet been aligned, this arrangement reduces this error and correspondingly increases the accuracy of the track alignment. But the alignment error reduction obtainable with this improved arrangement depends decisively on the lengths of the two reference chords, the positioning of their connecting point and the position of the trailing end point of the reference chord arranged ahead of the leading reference line end point in relation to the point of track alignment. Obviously, the most desirable relationships between these parameters are limited by structural conditions of the machine.

In the track alignment machine of Austrian Pat. No. 295,579, of Jan. 10, 1972, two longitudinally spaced track alignment tool means are mounted on the frame of the mobile machine to increase the alignment accuracy and reduce the stress of which the track rails are subjected by the alignment, a separate reference line being associated with each tool means for control thereof and these two reference lines cooperating with a common, long reference line extending from the track section to be aligned into the previously aligned track section and controlling the alignment. This machine aligns the track simultaneously at two points, the alignment at each track point being effected successively in two stages. The accuracy of the track alignment is considerably enhanced but errors remain because the leading end point of the long and determining reference line lies in the uncorrected track section.

In the otherwise conventional track alignment method and machine of Published German Patent Specification No. 1,244,824, published July 20, 1967, an additional rail sensing element is arranged ahead of the track alignment tool means in the track section to be aligned, in addition to the three rail sensing elements mounted in the range of this tool means and in the previously aligned track section. The average of the ordinates measured by the additional rail sensing element and the two rail sensing elements in the previously aligned track section can give a more accurate ordinate for the rail sensing element at the tool means but only if the track position error sensed by the additional rail sensing element is not too big since half of this error goes into the determination of the ordinate at the tool means. Furthermore, this known system is not capable of detecting residual errors produced during the alignment operation. Therefore, even under the most favorable conditions, there is no assurance that the median position of the aligned track section corresponds to that of the uncorrected track section. Another disadvantage of this system is the need to displace the trailing rail sensing element laterally in transition curves of the track to maintain the relative geometric position of the rail sensing elements required for the averaging of the ordinates. This constitutes a structural and operational disadvantage.

SUMMARY OF THE INVENTION

It is the primary object of this invention to improve the type of mobile track alignment machine first described hereinabove and making use of the basic track error reduction principle found very effective in track leveling and lining by further enhancing the operating accuracy and thus the track alignment, and by making it possible for the first time to correct sinuous track position errors having a wave length of about 50 to 80 m, which cause the cars of high-speed trains to swerve and had been almost impossible successfully to handle with conventional machines.

It is another object of the invention to provide this improvement with simple equipment capable of being incorporated into existing track alignment machines.

The above and other objects are accomplished according to the present invention in a machine of the first-described type with an additional rail sensing element in the trailing portion of the aligned, first track section, the additional rail sensing element being associated with a reference line means sensing element for determining residual track alignment errors. This reference sensing element emits a correcting operating signal corresponding to the residual alignment error for the drive means of the track alignment tool means.

In a mobile track alignment machine equipped with such an additional rail sensing element, the magnitude and the direction of residual and nascent track alignment errors are dependably determined within the range of the machine, and a corresponding correcting operating signal is used for the additional control of the alignment tool means to counteract any developing tendency of the aligned track to follow such residual errors. This correct operating signal may be constituted by an indication of the residual error which is used by an operator for the manual actuation of the drive means for the track alignment tool means to take the residual alignment error into account or it may be delivered directly to the control for automatically taking this error into account in the operation of the alignment tool means. Decisive for the reduction of residual track alignment errors to a minimum and the smoothing of long-wave sinuous track sections, which heretofore could be detected only by special electronic processing of measuring signals obtained by track measuring cars or by measurements in relation to fixed points, is not only the extension of the measuring base in the direction of the aligned track section due to the provision of the additional track sensing but the feeding of a correcting operating signal to control the alignment in relation to the reference system.

The above and other objects, advantages and features of this invention will become more apparent from the following detailed description of certain now preferred embodiments of mobile track alignment machines incorporating the invention, taken in conjunction with the accompanying, generally schematic drawing wherein

DESCRIPTION OF THE PREFERRED EMBODIMENTS

Figures 1, 2, 3, 4, 5:
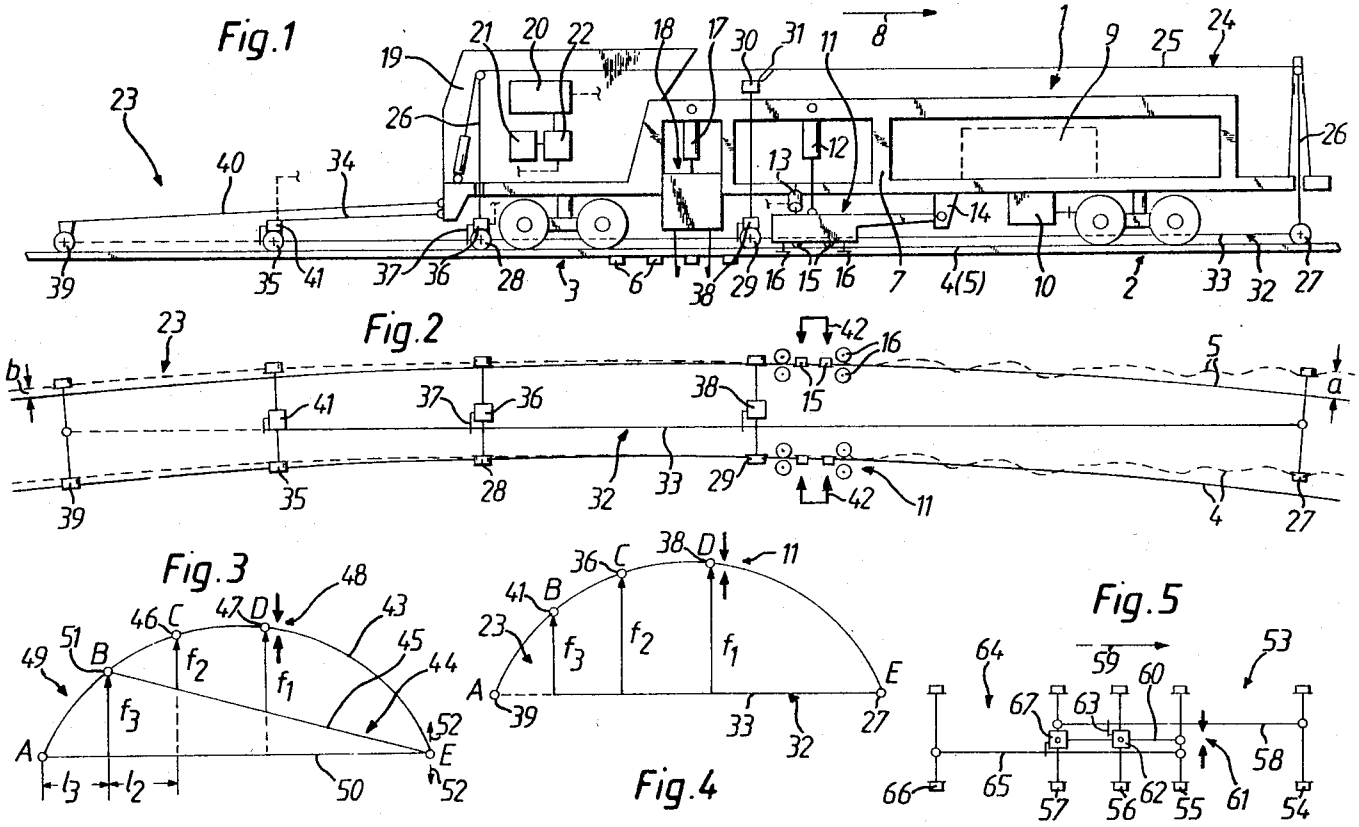
FIG. 1 is a side elevational view of a track tamping, leveling and lining machine embodying the present invention.
FIG. 2 is a diagrammatic top view of the reference system of the machine of FIG. 1.
FIG. 3 is a diagram showing the measuring principle in the operation of a reference system with a separate reference line associated with the additional rail sensing element.
FIG. 4 is a similar diagram showing the measuring principle involved in the embodiment of FIGS. 1 and 2.
FIG. 5 is a diagrammatic top view of a two-chord alignment reference system equipped with the additional rail sensing element arrangement of this invention.

Referring now to the drawing and first to FIG. 1, there is shown a mobile track alignment machine constituted by generally conventional track tamping, leveling and lining machine 1 having frame 7 mounted on swivel trucks 2, 3 for mobility on track rails 4, 5 fastened to ties 6. The machine moves from an aligned, first track section to a second track section to be aligned in an operating direction indicated by arrow 8. The front of machine frame 7 carries power plant 9 for operation of the machine, including drive 10 connected to the wheels of front swivel truck 2.

The machine comprises track alignment tool means positioned in the second track section, the illustrated tool means being a track lining and lifting unit 11 linked to machine frame 7 by drive means operating the tool means for alignment of the second track section, the illustrated drive means being constituted by hydraulic lifting jack 12 for track leveling and hydraulic lining jack 13 for track lining. The track lining and lifting unit is furthermore linked to bracket 14 of machine frame 7 so that it is pulled along the track with the advancing machine frame. The alignment tool means of unit 11 comprises, per rail, a pair of flanged rail engaging rollers 15 used for lining and two pairs of pincer-like flanged rollers 16 holding the rail therebetween and used for lifting. The machine also is equipped with a ballast tamping unit 18 associated with each rail 4, 5 and vertically adjustably mounted on machine frame 7 by hydraulic jack 17 for immersing the tamping tools in the ballast for tamping the ties. Operator's cab 19 is mounted on the rear end of machine frame 7 holding control 20 for drive means 12, 13.

Machine 1 furthermore comprises generally conventional leveling reference system 24 including a tensioned reference wire 25 associated with each track rail and defining a substantially perpendicular plane therewith. The front and rear ends of each reference wire 25 are respectively supported on rods 26 running on respective rail sensing elements 27 and 28 in the track section to be aligned and in the previously aligned track section, thus sensing the respective track levels in these sections. Another rail sensing element 29 for sensing the track level is positioned between track lining and lifting unit 11 and track tamping unit 18. Reference line sensing element 30 is supported on each rail sensing element 29 and has a fork-shaped feeler arm 31 cooperating in a known manner with associated reference line 25 and emitting an operating signal indicating the difference in the track level sensed by element 29 from reference line 25, which embodies the desired track level, and this operating signal is transmitted to, or used for, the actuation of hydraulic jack 12 so that unit 11 will lift the track to the desired level while flanged rollers 16 firmly clamp the rails.

Machine 1 also comprises lining reference system 32 for operating control 20 for hydrauic jack 13 in response to an operating signal emitted by this reference system and including reference line 33 extending along the track. In conventional lining reference systems, a single tensioned reference wire 32 (as shown in full lines in FIG. 2) extends along the track from the track section to be aligned into the previously aligned track section and three rail sensing elements 29, 28 and 35 each determining a respective ordinate of an arc in which the track extends cooperate with the track rails to sense their lateral position. One element 29 is arranged in the range of track alignment tool means 11, second element 28 is arranged in a leading portion of the first, aligned track section adjacent the second track section to be aligned, and third element 35 is arranged in a trailing portion of the first track section adjacent the leading first track section portion. In the illustrated embodiment, lining reference system 32 is associated with leveling reference system 24, in that a leading rail sensing element carrying a leading end point of reference line 33 in the second track section is constituted by leading rail sensing element 27 of reference system 24, the trailing end point of wire 33 being anchored to third rail sensing element 35 which is carried by tow-bar 34 pivotally attached to machine frame 7. Rail sensing elements 35, 28, 29 are arranged along common reference line 33 and each rail sensing element is associated with a respective reference line sensing element 41, 36, 38 having a fork-shaped feeler arm 37 cooperating with reference wire 33. Each reference line sensing element emits an operating signal transmitted to control 20. The operating signal emitted from reference line sensing element 36 corresponds to the ordinate or height of the arc of the lined track section at second rail sensing element 28 in relation to reference wire 33. The desired ordinate at rail sensing element 29 in the range of track lining unit 11 is directly derived from the parameter of the ordinate obtained from the signal of element 36 and the ratio of the distances of rail sensing elements 28 and 29 from third rail sensing element 35 according to the known geometric relations between the ordinates of arcs and the chords between points of the same arc, which are here embodied by rail sensing elements 27, 29, 28, 35. The corresponding operating signal emitted by element 38 controls the actuation of hydraulic drive 13 to move the track correspondingly laterally under the lateral thrust of flanged rollers 15 engaging the track rails. This lateral thrust is stopped and the lining movement is discontinued as soon as the operating signal emitted by element 28 has reached a previously computed lining value, i.e. the ordinate of the arc at rail sensing element 29 corresponds to the previously computed ordinate value.

According to the invention and as shown in broken lines in FIG. 2, this generally known reference system operating in a conventional manner disclosed in the patents mentioned hereinabove and whose pertinent disclosures are incorporated herein by reference is equipped with additional track alignment measuring means 23 comprised of additional rail sensing element 39 in the trailing portion of the aligned track section. Tow-bar arrangement 40 links element 39 to machine frame 7 and pulls it along the track. As shown in broken line, common reference line 33 has an extension to additional rail sensing element 39 and the trailing end point of the reference line extension is affixed to element 39. Instead of the trailing end point of common reference line 33 being affixed to third rail sensing element 35, reference line sensing element 41 cooperates with reference line 33 at this point and is thus associated with additional rail sensing element 39 for determining residual track alignment errors, element 41 emitting a correcting operating signal to control 20 corresponding to the residual alignment error. This arrangement is particularly simple and differs from the conventional reference system only by the extension of the common reference line to the additional rail sensing element. It has the advantage that all reference line sensing elements cooperate with one and the same reference line whereby common measuring conditions prevail at all measuring points, thus assuring enhanced measuring precision. Therefore, this simple embodiment attains the desired conformity of the average position of the aligned track with the average alignment of the track section to be aligned while largely suppressing residual track position errors.

FIG. 2 illustrates post-measuring arrangement 23 combined with lining reference system 32 purely schematically. Rails 4, 5 drawn in full lines show the track in the desired lateral alignment. The actual position of the track in the first, previously lined track section and the second track section to be lined is shown in broken lines, the lateral track position errors being shown at a considerably exaggerated scale for a better understanding. As indicated, the lateral track position at leading rail sensing element 27 in the second track section deviates from the desired lateral alignment of the track by distance a. In the range of track alignment tool means 11, i.e. at rail sensing element 29, the track has been laterally moved substantially into the desired alignment, arrows 42 indicating the lateral thrusts imparted to the track rails by engaging rollers 15 upon actuation of drive means 13. Since the leading end of lining reference wire 33 moves in the uncorrected track section, i.e. deviates from the corrected track position by distance a, an exact lining with respect to this reference cannot be obtained by this lining operation and a residual track alignment error corresponding to distance b between the actual and desired track positions at additional rail sensing element 39 remains. It is the task of post-measurement arrangement 23 of this invention to detect the magnitude, direction and developing tendency of this residual track alignment error and to produce a corresponding correcting operating signal fed to control 20 of drive means 13 so as to take this residual error into account to counteract the otherwise faulty alignment, as will be further explained hereinafter.

The diagram of FIG. 3 illustrates another embodiment of a lining reference system according to the present invention and is well suited for an explanation of the theoretical basis therefor. Arc 43 is designed to illustrate the longitudinal center line of a track. Points A to E on this arc indicate the center points of five rail sensing elements corresponding, or similar to, the arrangement of elements 39, 35, 28, 29 and 27 of the track alignment machine shown in FIG. 1. This machine is equipped with conventional lining reference system 44 including reference line 45 extending between points B and E as well as reference line sensing elements 46 and 47 at points C and D, element 47 being arranged in the range of track alignment tool means 48 which comprises lining tools for laterally moving the track in either direction, as indicated by the two arrows pointing in opposite directions. As has been explained in connection with the description of FIGS. 1 and 2, ordinates $f_1$ and $f_2$ with respect to reference line 45 are measured at points C and D by reference line sensing elements 46 and 47.

In addition to this conventional lining reference system, the invention provides post-measuring arrangement 49 including second, separate reference line 50 extending from leading point E of the reference system and its first reference line 45, beyond trailing end point B of the first reference line to its trailing end point A at which the additional rail sensing element is positioned. Arrangement 49 has a reference sensing element 51 at trailing end point B of first reference line 45 and this element measures lateral distance $f_3$ between reference lines 45 and 50 in the range of point B. In a theoretically ideal track alignment, i.e. if the corrected track position fully coincided with the desired position, track points A to C would be positioned exactly on arc 43 and there would be a fixed ratio between ordinates $f_2$ and $f_3$, which is determined by the lengths of chord sections $l_2$ and $l_3$, and is independent from the radius of arc 43, thus being valid also for a straight line, i.e. an arc of an infinite radius. In fact, such an ideal track alignment is not possible. For the above-indicated reasons, residual track alignment error b remains, causing a corresponding lateral displacement of point A and a resultant displacement of second reference line 50. The ratio between ordinates $f_2$ and $f_3$ is changed accordingly and deviates from the ideally fixed ratio, and the correcting operating signal is derived from this deviation to control track lining tool 48.

This arrangement is particularly adapted for simply modifying existing track alignment machines since their reference system may remain unchanged and the modification is limited to equipping the machine with an additional rail sensing element, the second reference line and the reference line sensor associated therewith. The second reference line offers an extended reference for the system and its relationship to the first reference line of the existing system is used to provide correction of the residual alignment error.

As shown in FIG. 1, the machine preferably comprises device 22 receiving the correcting operating signal and transmitting the signal to control 20. Signal receiving and transmitting device 22 forms an alignment control signal from the average of the residual alignment errors determined by the additional rail sensing element over a predetermined length of the trailing portion of the first track section. Advantageously, device 22 comprises signal filter means filtering out correcting operating signals corresponding to minor residual alignment errors below a selected threshold. A track alignment correction parameter obtained on the basis of this principle represents the average deviation between the first-corrected track position and the uncorrected position of the track. By controlling the drive means of the track lining tool in response to this parameter and imparting thereto an additional and correcting lining movement in a direction opposite to this average deviation, the median position of the finally aligned track will conform to the median position of the uncorrected track. Therefore, the aligned track will generally follow the median position of the non-aligned track but will be free of its alignment errors, including the long-wave, periodic errors encountered along tracks after extended use. Such an aligned track is characterized by an exceptionally accurate alignment and the elimination of residual track position errors to the highest extent practically attainable.

Referring specifically to the embodiment of FIG. 3, the operating signals from reference sensing elements 46 and 51, which correspond to the respective ordinates measured by these elements, are received by a comparator device, i.e. device 22, which comprises a computer storing constants corresponding to the fixed length ratios. Comparing these constants with the signals received from elements 46 and 51, which short-wave variations have been filtered, the comparator device forms an average value from the positive and negative residual track alignment errors over a predetermined length of the corrected track section. If desired, this average value may be multiplied by an experimentally obtained factor which classifies the significance of the residual alignment error tendency. The output signal of device 22 is transmitted to control 20 and, as shown in FIG. 1, may also be transmitted to indicating instrument 21 where it is made visible and, if desired, recorded. The correcting operating signal transmitted by device 22 may be used in two ways for controlling the drive means of track lining tool 48:

(1) Means responsive to the correcting operating signal displaces leading end point E laterally in a direction opposite to that of the detected tendency of the track to deviate from the desired alignment, as indicated by arrows 52 in FIG. 3, thus repositioning first reference line 44 to eliminate the residual alignment error whereby alignment tool 48 will automatically execute an additional lining movement in relation to the repositioned first reference line.

(2) Alternatively, the correcting operating signal is transmitted to drive means control 20 for track alignment tool means 48. This control transmits electrical control adjustment signals to the drive means and the correcting operating signals are adapted to correct the adjustment signals to eliminate the residual track alignment errors.

In the first alternative, the position of the reference system controlling the lining drive is corrected in a direction opposite to that of the residual alignment error so that the drive is automatically adjusted. Preferably, the leading end point of this reference system is automatically displaced in response to the correcting operating signal, for example by remote control of an electric motor.

In the second alternative, the correcting operating signal is fed into the control for the lining drive to adjust the same correspondingly. This has the advantage of requiring only a minor modification of the existing control by building the necessary electrical or electronic component thereinto.

By filtering out minor correcting operating signals corresponding to short-wave track alignment errors, any undesirable influence of the post-measuring arrangement on the reference system is avoided so that such errors sensed by the rail sensing elements, but which have no practical bearing on the desired track alignment, are excluded from the operation. Such negligible errors excluded by the signal filter include short corrugations and other periodic points of wear on the rail heads engaged by the rail sensing elements. Furthermore, by excluding short-wave variations, the filter will contribute to the smooth operation of the electrical indicating, signal processing and control means.

FIG. 4 schematically shows the reference system of the embodiment of FIGS. 1 and 2, based substantially on the same principles for detecting the residual alignment error and forming the corresponding correcting operating signal as set forth hereinabove in connection with FIG. 3. However, reference line means 33 of this embodiment is constituted by common reference line 32 extending between points E and B, with an extension to point A. Reference line sensing elements 41 and 36 respectively determine ordinates $f_3$ and $f_2$ at points B and C, i.e. rail sensing elements 35 and 28. As has been explained in connection with FIG. 3, the ratio between the two ordinates in the aligned track section is a fixed parameter in the theoretical ideal condition in which the aligned track fully conforms to the desired track position. To form the correcting operating signal, reference line sensing elements 41 and 36 are connected to signal receiving and transmitting device 22, as shown in broken lines in FIG. 1. This device is connected to indicating device 21 and to control 20 to transmit the filtered signal for visual reading at device 21 and control of drive 13 of lining unit 11, as also shown in broken lines in FIG. 1.

FIG. 5 schematically illustrates yet another embodiment of generally conventional, two-chord lining reference system 53. This reference system includes leading rail sensing element 54 and one rail sensing element 55 at track alignment tool means 61 in the track section to be aligned, and second rail sensing element 56 in a leading portion and third rail sensing element 57 in a trailing portion of the aligned track section, the mobile machine incorporating this reference system proceeding in the direction of arrow 59. Long reference chord 58 extends from leading rail sensing element 54 to trailing third rail sensing element 57 while short reference chord 60 extends from rail sensing element 55 to element 57. Reference line sensing element 52 associated with rail sensing element 56 has sensing fork 63 cooperating with long reference chord 58. According to the conventional two-chord alignment method, element 62 measures the ordinate in the range of rail sensing element 56 in relation to long reference chord 58, calculates the ordinate in relation to short reference chord 60 in the range of this rail sensing element on the basis of the known geometric relations between ordinates of two chords of different lengths subtending an arc, and tool means 61 is then actuated to move the track and rail sensing element 55 engaged therewith laterally until the ordinate in the range of rail sensing element 56 conforms to the calculated value of the ordinate.

According to the invention, this conventional reference system is modified by adding post-measuring arrangement 64 thereto. This arrangement comprises another reference line 65 overlapping the leading and trailing portions of the aligned track section to extend from rail sensing element 55 of reference system 53 to additional rail sensing element 66 in the trailing portion of the aligned track section. Arrangement 64 has reference line sensing element 67 associated with trailing rail sensing element 57 of reference system 53 and which measures the ordinate at element 57 in relation to overlapping reference line 65. Here, too, there is a definite geometric relationship between the ordinates measured by elements 62 and 67, which corresponds to the ratios of the distances between the rail sensing elements and the reference chords. Again, as in the heretofore described embodiment, deviations from the ideal track position are analogously translated into a correcting operating signal for the control of lining unit 61.

While the present invention has been described and illustrated in connection with specific embodiments relating to track lining, it will be obvious to those skilled in the art that other and equivalent embodiments of reference systems may be used and applied to track leveling as well. Obviously, the reference line means may be constituted not only by tensioned wires but optical reference lines may be used, in which case the electromechanical reference line sensors are replaced by suitable optical sensors. Thus, the scope of this invention is defined by the appended claims.

What is claimed is:

1. A mobile track alignment machine mounted for mobility on the track rails for movement from an aligned, first track section to a second track section to be aligned, which comprises (a) track alignment tool means positioned in the second track section, (b) drive means operating the tool means for alignment of the second track section, (c) a control for the drive means and (d) a reference system for operating the drive means control in response to an operating signal emitted by the reference system and including (1) a reference line means forming a chord of an arc in which the track extends and (2) three rail sensing elements each determining a respective ordinate of the arc, one of the rail sensing elements being arranged at the track alignment tool means, a second one of the rail sensing elements being arranged in a leading portion of the first track section adjacent the second track section, a third one of the rail sensing elements being arranged in a trailing portion of the first track section, and an additional rail sensing element, wherein the improvement comprises arranging the additional rail sensing element in the trailing portion of the first track section and associating the additional rail sensing element with a reference line means sensing element for determining residual track alignment errors, the reference line means sensing element associated with the additional rail sensing element emitting a correcting operating signal corresponding to the residual alignment error.

2. The mobile track alignment machine of claim 1, wherein the reference line means is constituted by a common line extending along the second track section and the leading and trailing portions of the first track section.

3. The mobile track alignment machine of claim 2, wherein the three rail sensing elements are arranged along the common reference line and the common reference line has an extension to the additional rail sensing element, each one of the rail sensing elements being associated with a respective reference line means sensing element and the reference line means sensing element associated with the additional sensing element being the reference line means sensing element associated with the third rail sensing element.

4. The mobile track alignment machine of claim 1, wherein the reference line means is constituted by a first reference line extending along the track sections, the three rails sensing elements being associated with the first reference line and a second, separate reference line extending along the track sections to the additional rail sensing element, a respective one of the reference line means sensing elements associated with the additional rail sensing element being arranged for measuring the distances between the first and second reference lines in the range of the second and third rail sensing elements.

5. The mobile track alignment machine of claim 1, wherein the reference line means is constituted by a line extending along the second track section and the leading portion of the first track section and another line overlapping the leading and trailing portions of the first track section.

6. The mobile track alignment machine of claim 1, further comprising a device receiving the correcting operating signal from the reference line sensing element associated with the additional rail sensing element and transmitting the signal, the signal receiving and transmitting device forming an alignment control signal from the average of the residual alignment errors determined by the additional rail sensing element over a predetermined length of the trailing portion of the first track section.

7. The mobile track alignment machine of claim 6, wherein the signal receiving and transmitting device comprises signal filter means filtering out correcting operating signals corresponding to minor residual alignment errors.

8. The mobile track alignment machine of claim 1, wherein the reference system further includes a leading rail sensing element carrying a leading end point of the reference line in the second track section, and means responsive to the correcting operating signal for displacing the leading end point in response to the correcting operating signal.

9. The mobile track alignment machine of claim 1, wherein the drive means control for the track alignment tool means transmits electrical control adjustment signals to the drive means and the correcting operating signals are adapted to correct the adjustment signals to eliminate the residual track alignment errors.

* * * * *